US005671480A

United States Patent [19]

Krout et al.

[11] Patent Number: 5,671,480

[45] Date of Patent: Sep. 30, 1997

[54] SIGNALING DEVICE

[76] Inventors: Kevin Krout, 110 Woodlawn Pl., Crawfordsville, Ind. 47933; Dennis Wilson, 300 S. Indiana St., Roachdale, Ind. 46172

[21] Appl. No.: 591,382

[22] Filed: Jan. 25, 1996

[51] Int. Cl.[6] ..... A41D 1/04; B63C 9/08; G09F 17/00

[52] U.S. Cl. ..... 2/102; 441/89; 441/113; 441/114; 116/173

[58] Field of Search ..... 2/69, 102; 441/89, 441/113, 114; 116/209, 210, 173, 174, 175

[56] References Cited

U.S. PATENT DOCUMENTS

| | | | |
|---|---|---|---|
| 51,971 | 1/1866 | Rousseil . | |
| 2,794,414 | 6/1957 | Reifschneider | 116/173 |
| 2,999,149 | 9/1961 | Cook, Jr. | 116/173 |
| 3,122,736 | 2/1964 | Weber | 441/89 |
| 3,946,699 | 3/1976 | Mirshak | 116/173 |
| 4,035,856 | 7/1977 | Oberge | 441/89 |
| 4,598,661 | 7/1986 | Roe | 116/209 |
| 4,752,264 | 6/1988 | Melendez et al. | 441/89 |
| 5,029,551 | 7/1991 | Rosen | 441/89 |
| 5,083,956 | 1/1992 | Chraghahian et al. | 441/89 |
| 5,423,282 | 6/1995 | Krull et al. | 441/89 |
| 5,459,874 | 10/1995 | Meredith | 441/114 |
| 5,472,166 | 12/1995 | Wear | 248/514 |

*Primary Examiner*—Bibhu Mohanty
*Attorney, Agent, or Firm*—Brinks Hofer Gilson & Lione

[57] ABSTRACT

A flag-type signaling device for indicating the position of and enhance the visibility of the wearer, particularly while afloat in water. The device includes a first member defined, in one embodiment, by a flotation vest to be worn about the torso of a user, and a second member attached to or made as an integral part of the first member and cooperating therewith to form therebetween an interior region, a third member defined by a wedge-shaped element disposed within the interior region, and a visibility enhancing member extending downwardly within the interior region bearing against the wedge-shaped element such that the upper portion of the visibility enhancing member extends upwardly and divergingly rearwardly away from the rear of the user's head to reduce or prevent the potential of the visibility enhancing member striking the back or rear of the user's head while the device is worn by the user.

2 Claims, 6 Drawing Sheets

SIGNALING DEVICE

FIELD OF THE INVENTION

This invention relates to signaling devices and, in particular, to signaling devices to be worn to indicate the position of and enhance the visibility of the wearer. More particularly, the invention relates to flag-type devices attached to or made an integral part of an article of clothing to be worn about the torso of a user.

BACKGROUND OF THE INVENTION

Signal devices to be used by downed water skiers to indicate their position are known. See, for example, U.S. Pat. No. 3,122,736 to Weber; U.S. Pat. No. 4,035,856 to Oberg; U.S. Pat. No. 4,598,661 to Roe; U.S. Pat. No. 4,752,264 to Melendez, et al.; U.S. Pat. No. 5,029,551 to Rosen; and U.S. Pat. No. 5,423,282 to Krull, et al. Each of these patents is concerned primarily with the risk of injury to water skiers when they are down in the water. However, the need for enhanced visibility is of a more general nature, and water skiing is simply one well-recognized application for such inventions. Other applications, for example, would be highway workers, bicycle riders and the like.

Each of the above prior patents helps to signal the location of a person floating in water. However, a problem common to all of the known devices is the discomfort caused by the location of a rigid or semi-rigid mast directly behind or adjacent the user's spine and head. Another common problem is the discomfort and potential for injury due to the relatively hard, rigid composition of the mast possibly striking the rear of the head of the wearer while in use.

SUMMARY OF THE INVENTION

The present invention provides a signaling device to be worn about the torso of a user to indicate his or her whereabouts by enhancing his or her visibility to others. The device comprises a first member intended to be carried upon a user's torso and a second member attached to or made as an integral part of the first member. A visibility-enhancing member is carried by the second member and extends upwardly and rearwardly from the second member and away from the user's head. The first member and second member cooperate to urge or bias the visibility-enhancing member in a divergent orientation relative to the user's head. The second member can include a three-sided piece or portion of material or the like, and can further include a pocket for receiving the visibility-enhancing member. The second member can also include a three-dimensional triangular wedge having an apex and a base, with the apex being operatively positioned below the base. The visibility-enhancing member can include a flexible mast having a first end positioned within the pocket and a second end extending out of the pocket with a pennant, flag or the like attached thereto.

In one embodiment of the invention, the first member is carried by or made a part of a flotation device or vest to be worn by a person engaging in water-related activities, whether it be skiing, tubing, swimming, etc. The material piece of the second member, attached to the back of the flotation device, defines an interior region between the material piece and the flotation device for receiving therein the wedge member. The wedge member can be defined by a buoyant wedge specifically sized and configured to fit within the interior region. A pocket can also be carried by the second member, either attached to the second member or formed in the third member. A flexible mast can then be inserted in the pocket, wherein the disposition of the pocket upon the second member orients the flexible mast and its accompanying flag to be directed upwardly and rearwardly of the user and away from the user's head.

In another embodiment of the invention, the first member includes a vest or shirt-type article of clothing worn by a user, such as a cyclist or highway worker. It is also possible, of course, for a skier or swimmer to wear the vest or shirt-type article of this second embodiment simply disposed over a conventional flotation device.

Additional advantages and novel features of the invention will become apparent to those skilled in the art upon consideration of the following detailed description of preferred embodiments of the invention, which exemplify the best mode of carrying out the invention when considered in conjunction with the accompanying drawings.

BEST MODE FOR CARRYING OUT THE INVENTION

Figure 1:
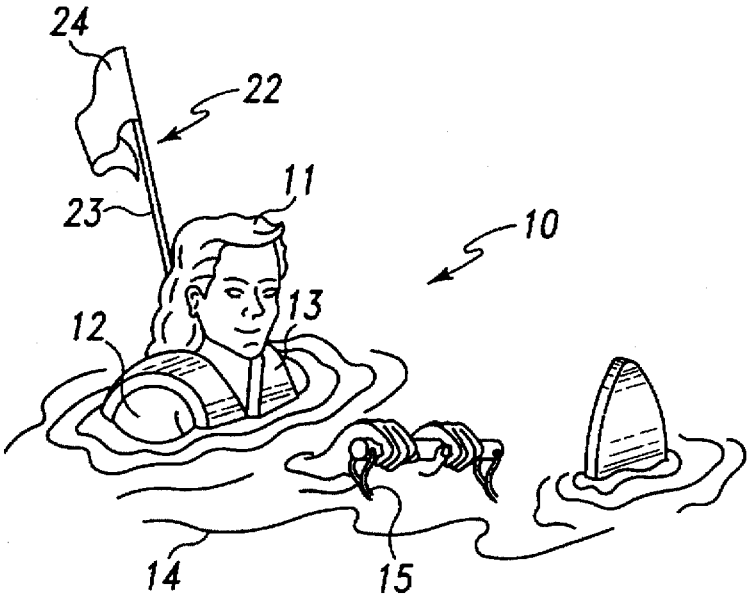
FIG. 1 is a perspective view of a skier in the water wearing the signalling device of the present invention.

Referring now to the drawings wherein like reference numerals designate identical or corresponding elements throughout the several views, FIG. 1 shows a user in a starting position for slalom skiing in which the user, generally referenced through the figures by reference numeral 10, floats largely beneath the water surface 14 such that only the user's head 11 and the shoulder portion 12 of a flotation device 13 extends above water surface 14. Flotation device 13 provides buoyancy to assist in the flotation of user 10.

Figure 2:
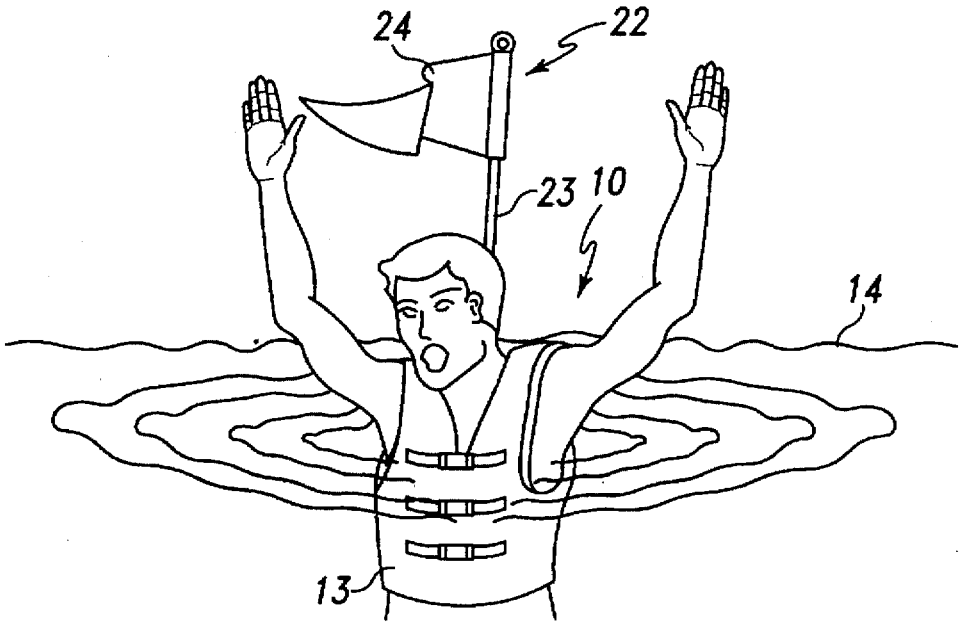
FIG. 2 is a perspective view of a swimmer in the water wearing the signalling device of the present invention.

FIGS. 1 and 2 point out the relatively small portion of the anatomy of user 10 that extends above water surface 14 as a person rests or floats in the water. Accordingly, it will be apparent that the user's profile is relatively small and, as can be anticipated, a user in the position shown in FIGS. 1 and 2 is relatively hard to observe from oncoming speeding power boats and nearby docks, the shoreline, etc.

FIGS. 1–4 show the signalling device 20 of the present invention secured to a flotation device 13 with a visibility enhancing member 22 extending above the user's head to indicate his position in or on the water. The visibility enhancing member 22 includes a flexible mast 23 carrying a safety flag 24 at its upper distal end. It will be appreciated that the flag 24 can be defined as a banner, pennant, streamer or the like.

Figure 3:
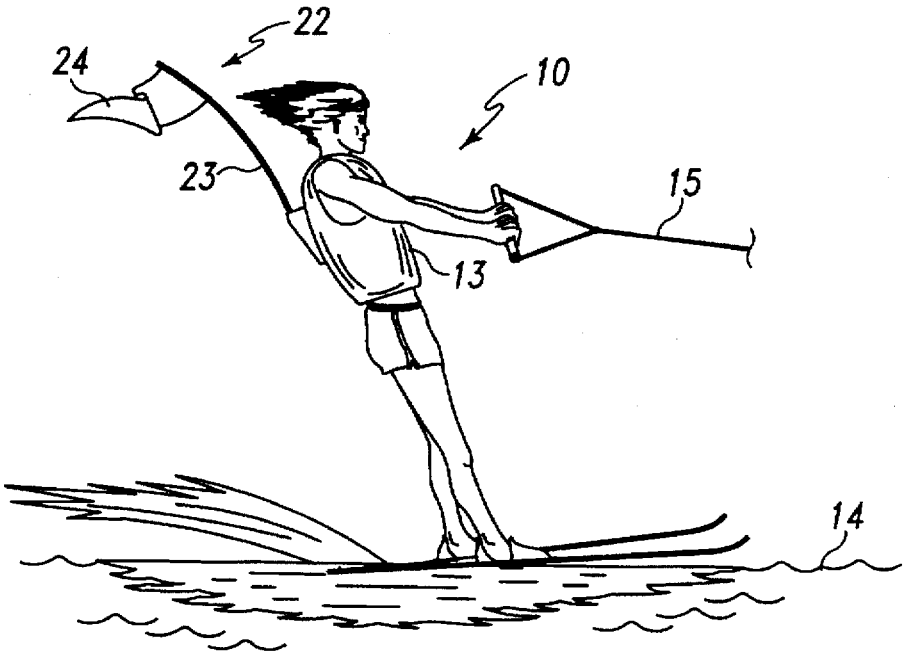
FIG. 3 is a view of a skier atop the water wearing the signalling device of the present invention, showing the flag being deflected rearwardly away from the user's head.
Figure 4:
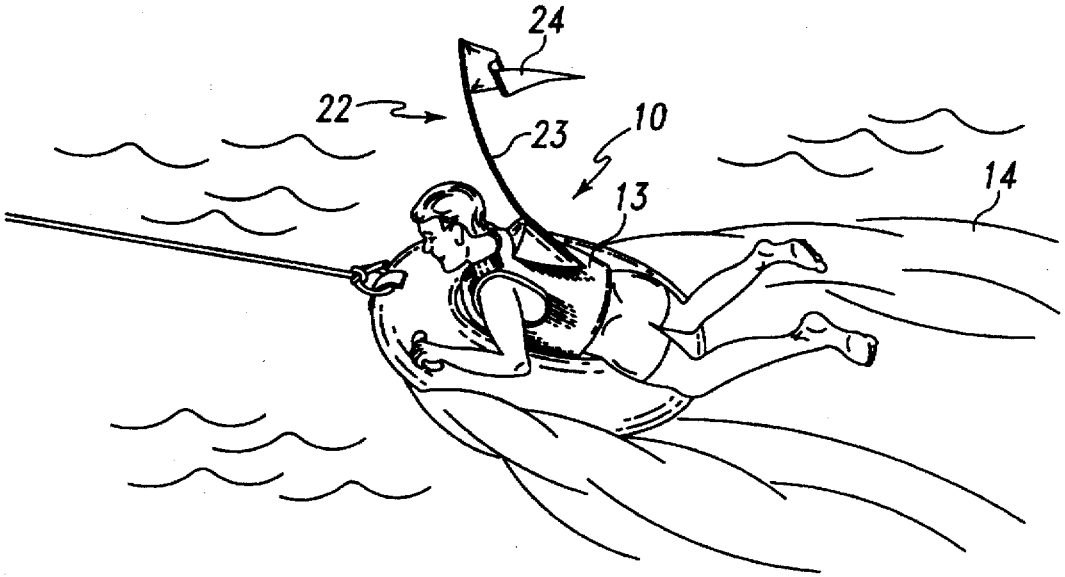
FIG. 4 is a side view of a swimmer wearing the signalling device of the present invention positioned atop a towed device such as an inner tube or the like with the signalling device of the invention being deflected rearwardly away from the user's head.

FIG. 3 shows a typical user 10 in the position assumed during actual skiing in which user 10 rides upon water surface 14 in accordance with conventional water skiing practices. User 10 is shown in FIG. 3 wearing flotation device 13 with its accompanying flexible mast 23 and safety flag 24. As shown in FIGS. 3 and 4, because of the structure of the invention discussed below and because of the flexibility of mast 23, the wind resistance of safety flag 24 causes flexible mast 23 to curve and move the relative position of safety flag 24 and flexible mast 23 rearwardly away from the body of user 10 to prevent or substantially reduce the potential of the mast 23 striking the rear of the user's head, which is a common problem with the conventional devices that include no means to, while in a static mode, orient the flag mast up and away from the head of the user. This is particularly advantageous when a user "tubes" as shown in FIG. 4 because of the user's already somewhat horizontal position that would otherwise merely enhance the potential of the mast 23 and flag 24 striking the head of the user and/or interfering with his or her field of vision. The flexibility and the angular orientation of mast 23 cooperate with the wind produced by the motion of user 10 to also virtually remove Safety flag 22 from the field of vision of user 10 and avoids any interference which the fluttering of flag 22 might otherwise cause to the user 10.

Figure 5:
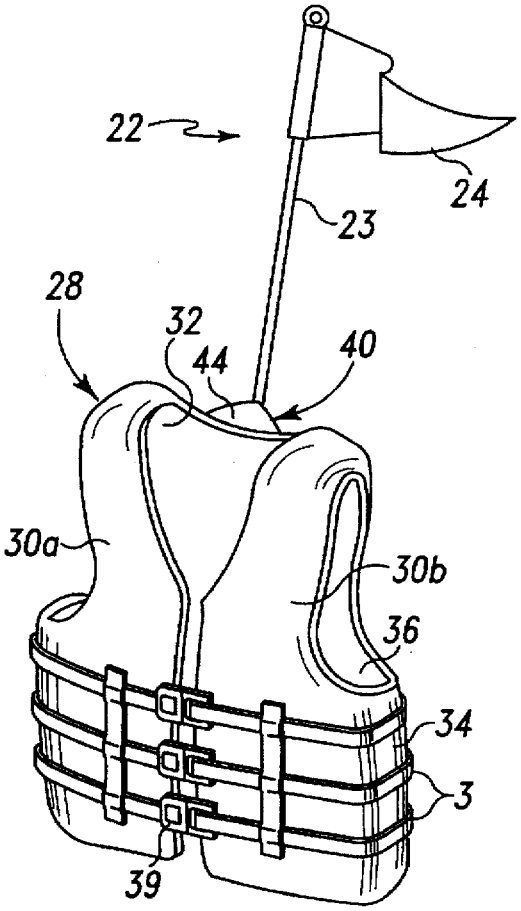
FIG. 5 is a front perspective view of a flotation device incorporating the present invention.
Figure 6:
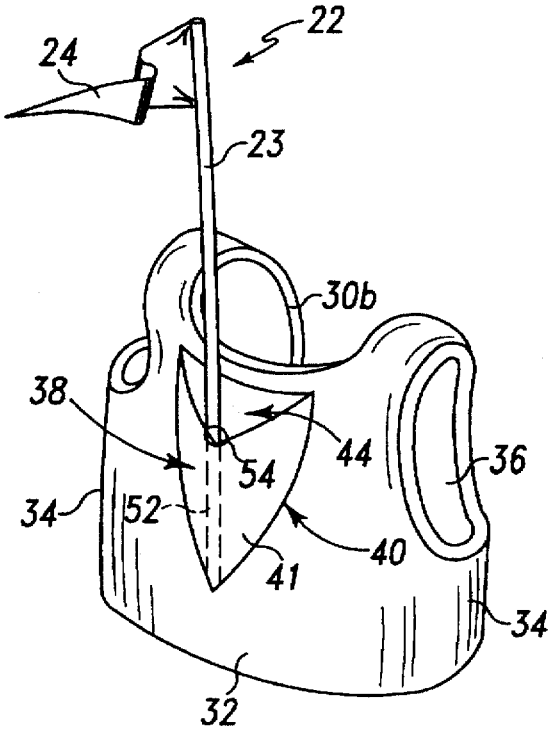
FIG. 6 is a rear perspective view of the flotation device of FIG. 5 with the securing straps omitted for clarity.

FIGS. 5 and 6 show front and rear views of one preferred embodiment of the invention wherein a first member 28 can comprise a back panel 32 to which is attached a second member 40. Side panels 34 can further be provided connecting front panels 30*a*, 30*b* and back panel 32. The front panels 30*a*, 30*b* can be further joined to the back panel 32 to form shoulder portions and thereby cooperate with the side panels 34 to define arm holes 36. Fastening strap means 38 can be employed for releasably securing the invention about the torso of a user 10 byway of conventional snap-type buckles 39 well known in the art.

Figure 7:
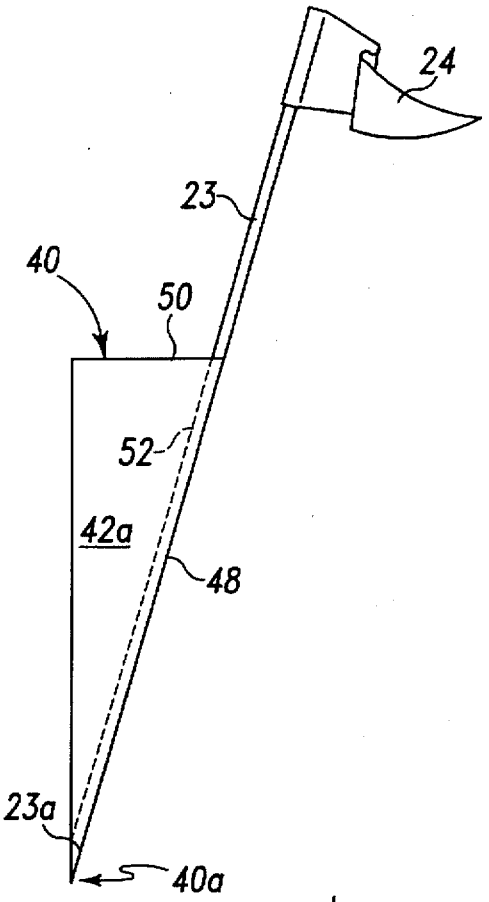
FIG. 7 is a side view of the second member of the invention showing a mast positioned in a pocket formed therein.
Figure 8:
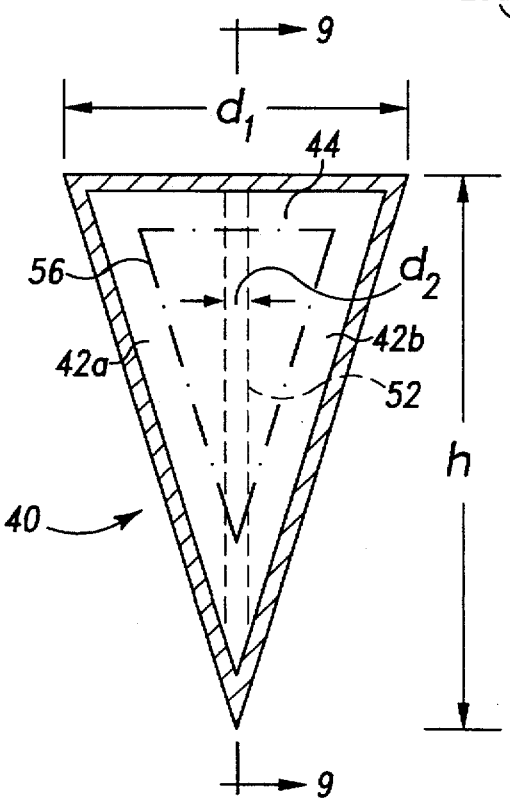
FIG. 8 is a plan view of the second member showing in phantom lines the relative positioning of a triangular third member therewithin.
Figure 9:
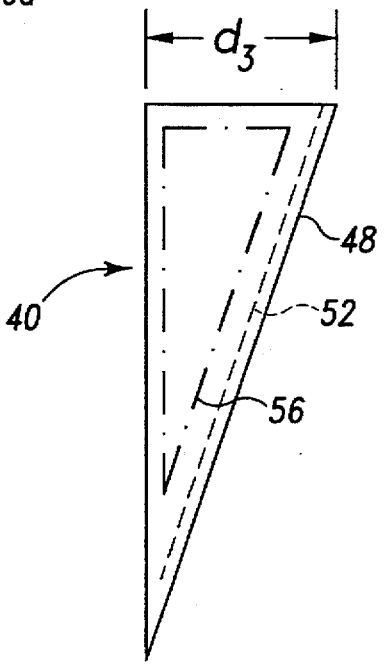
FIG. 9 is a side view similar to FIG. 7 showing the third member and the interior pocket disposed within the interior region of the invention.

Second member 40, illustrated in FIGS. 7–9, can be attached to the first member back panel 32 and can include a pouch-like member 41 defined by a piece of fabric or other suitable material that cooperates with the back panel 32 to define a triangular wedge-shaped interior region 38 therebetween. The material piece 41 of second member 40 can also include first and second sides 42*a*, 42*b* and top side 44. The first and second sides 42*a*, 42*b* are joined to each other along edge 48 and to the top side 44 along edge 50. A pocket 52 extends preferably along the entire edge 48 from the top of the material piece 41 of second member 40 to its bottom and can be formed by a seam between the first and second sides 42*a*, 42*b* or an additional piece of fabric or the like attached to the first and second pieces 42*a*, 42*b*. The top side 44 includes an aperture or opening 54 (FIG. 6) positioned to coincide with the termination of the pocket 52 at its upper end. A pocket 52 and aperture 54 are sized to receive the flexible mast 23 so that the lower end of mast 23 can be positioned within the pocket 52 adjacent to the lower end 40*a* of second member 40.

Figure 10:
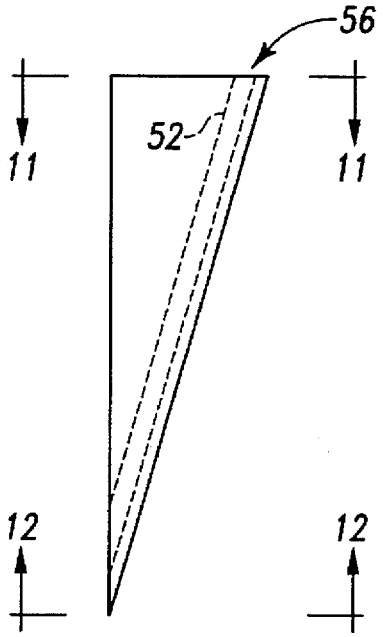
FIGS. 10–13 show side, top, bottom, and plan views, respectively, of the third member of the invention.
Figure 11:
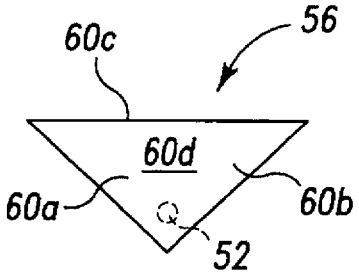
Figure 12:
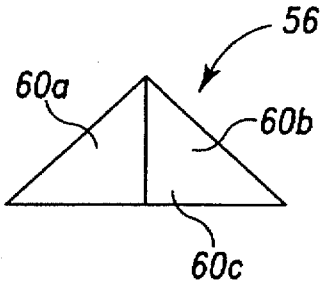
Figure 13:
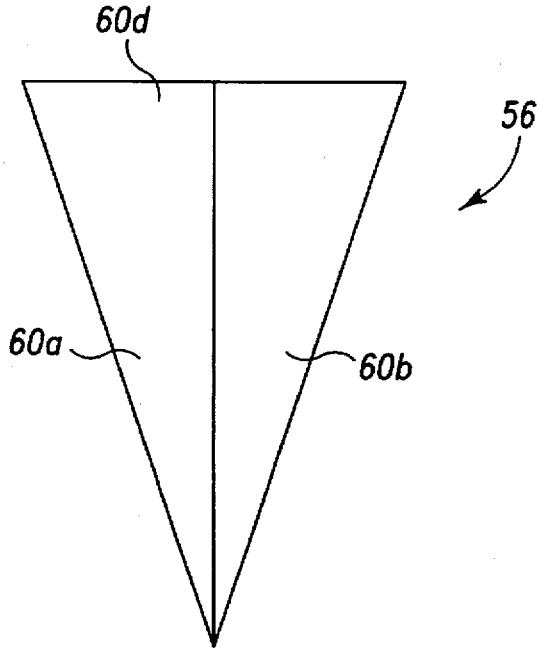

Second member 40 can further include a wedge member 56, illustrated in FIGS. 10–13, preferably defined by a triangular wedge element particularly sized and configured to fit within the interior region 38 defined between the material piece 41 of second member 40 and the back panel 32. Wedge member 56 is preferably constructed from a rigid, light-weight, buoyant material, and includes four surfaces 60*a*, 60*b*, 60*c*, and 60*d* (see FIG. 11). When wedge member 56 is disposed within the interior region 38, surfaces 60*a*, 60*b* are positioned adjacent sides 42*a*, 42*b* of the material piece 41, surface 60*c* is positioned adjacent the back panel 32, and fourth surface 60*d* is positioned adjacent the top side 44 of material piece 41. With the wedge member 56 disposed within the interior region 38, the flexible mast 23 is positioned in the pocket 52 with wedge member 56 assisting in biasing the mast 23 in a rearwardly inclined position relative to the user's head. As shown in FIGS. 10–11, the pocket 52 can also be formed in wedge member 56 if desired to eliminate pocket 52. Thus, the material piece 41 of second member 40 is attached to the back panel 32 of, for example, a flotation device 28 so as to orient the pocket 52 upwardly and rearwardly from the user 10. Accordingly, when the visibility enhancing member 22 is inserted into the aperture 54 and received downwardly into pocket 52, the safety flag 24 is positioned well behind and diverging away from the user's head.

Figure 14:
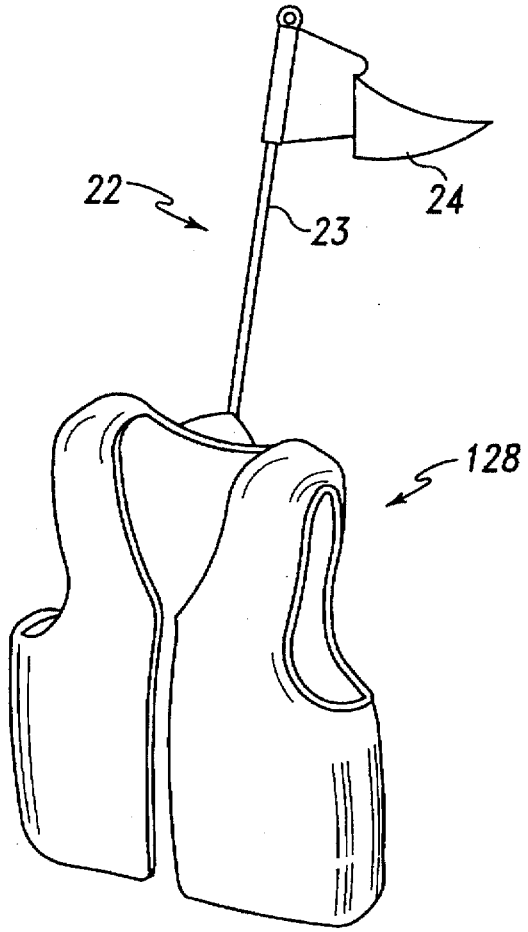
FIG. 14 is a front perspective view of an alternative embodiment of the invention wherein a flexible mast and flag are incorporated into a vest-type article.

FIG. 14 illustrates an alternative embodiment of the invention. The embodiment of FIG. 14 is a non-flotation vest-like article 128 that can be worn over a flotation device, when suitable fastening means are attached, or by a road worker or the like to enhance the user's visibility to others. No securing means are shown in FIG. 14 for purposes of clarity. In yet another embodiment, the invention could include sleeves and define a shirt-like article.

In one preferred embodiment, the dimensions of the interior region 38, as shown in FIGS. 8–9, include a height of about 16 inches, a width $d_1$ of about 6 inches, and a depth $d_3$ of about 3.50 inches. Of course, the dimensions of wedge member 56 correspond generally to the interior dimensions of the interior region 38. The pocket 52 can have a diameter $d_2$ of about 0.5 inch.

Mast 23 is preferably constructed from a flexible composite or fiberglass material that repeatedly returns to a straight linear form after being subjected to the bending force of the wind resistance. Such a suitable mast is a unidirectional fiberglass-reinforced polyester rod available from Glass Forms, Inc., San Jose, Calif. Material piece 41 of second member 40 can be constructed of a conventional woven fabric commonly used in the construction of flotation vests or life jackets and the like, to enclose or envelop the buoyant material or padding. Such a fabric is typically made from neoprene, nylon or other suitable material.

Figure 15:
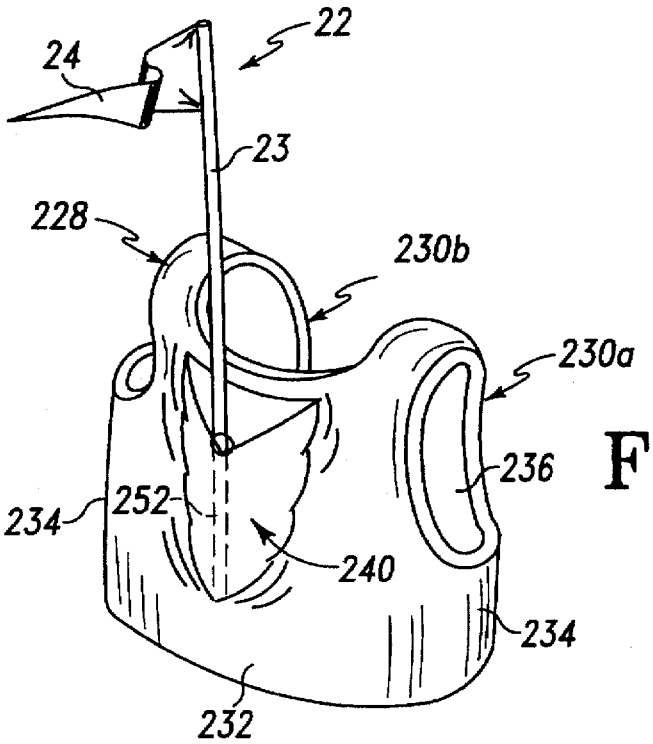
FIG. 15 is a rear perspective view of yet a further embodiment of the signalling device of the present invention.

As noted above and shown in FIG. 15, the device of this invention in an even further embodiment eliminates material piece 41 and wherein the second member 240 is an integral part of the first member 28. In this embodiment, there would be no interior region 38 per se as the back panel 232 of the first member 228 would simply include an outwardly protruding portion 240, instead of a separate member attached to back panel 232, with the wedge member or other suitable padding disposed therein to urge the back panel 232 rearwardly away from the head of the user. In all other aspects, this embodiment is substantially identical to that shown in FIGS. 5 and 6, and includes front panels 230*a* and 230*b*, a back panel 232 and side panels 234 connecting the front panel to the back panel and forming shoulder portions to further define arm holes 236. For clarity, no securing straps or fastening means are shown in FIG. 15.

Although the invention has been described in detail with reference to a particular preferred embodiment, variations and modifications exist within the scope and spirit of the invention as described and defined in the following claims.

We claim:

1. A flotation vest equipped with a signaling device, comprising:

a flotation vest wearable about the torso of a user;

a cover member disposed on the back of the flotation vest and cooperating therewith to form therebetween a wedge-shaped interior region, said cover member including a pocket disposed longitudinally thereof;

a visibility-enhancing member receivable within said pocket; and a wedge disposed between the back of the flotation vest and the pocket for orienting the pocket to project the visibility-enhancing means upwardly and diverging rearwardly away from the user to reduce or prevent contact between the visibility-enhancing member and the head or back of the user.

2. A signaling device, comprising:

a pouch defining an interior region;

a wedge disposed within the interior region of said pouch;

a pocket carried longitudinally by said pouch accessible from the exterior of said pouch;

a signal flag having a flexible mast positionable within said pocket; and a biasing member, coupled to the pouch, for positioning the signal flag on a user's back, the signal flag being biased upwardly and diverging rearwardly away from the user's head and back.

* * * * *

UNITED STATES PATENT AND TRADEMARK OFFICE

CERTIFICATE OF CORRECTION

PATENT NO. : 5,671,480

DATED : September 30, 1997

INVENTOR(S) : Kevin Krout, et al.

It is certified that error appears in the above-indentified patent and that said Letters Patent is hereby corrected as shown below:

In Col. 3, line 38, delete "Safety" and insert therefor --safety--.

In Col. 3, line 50, delete "byway" and insert therefor --by way--.

In Col. 4, line 52, delete "Calif." and insert therefor --California.--

Signed and Sealed this

Thirtieth Day of December, 1997

Bruce Lehman

*Attest:*

BRUCE LEHMAN

*Attesting Officer*

*Commissioner of Patents and Trademarks*